US007497732B2

(12) United States Patent
Yi

(10) Patent No.: US 7,497,732 B2
(45) Date of Patent: Mar. 3, 2009

(54) LOW PROFILE ELECTRICAL CONNECTOR

(75) Inventor: Chong Yi, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/880,920

(22) Filed: Jul. 25, 2007

(65) Prior Publication Data

US 2009/0029567 A1 Jan. 29, 2009

(51) Int. Cl.
*H01R 13/648* (2006.01)

(52) U.S. Cl. ..... 439/607

(58) Field of Classification Search ..... 439/607
See application file for complete search history.

(56) References Cited

U.S. PATENT DOCUMENTS 5,779,489 A 7/1998 Davis et al.
7,232,346 B2 6/2007 Hu et al.
2005/0048839 A1* 3/2005 Zhang ..... 439/607
2007/0117459 A1* 5/2007 Chen ..... 439/607

* cited by examiner

*Primary Examiner*—Ross N Gushi
(74) *Attorney, Agent, or Firm*—Wei Te Chung

(57) ABSTRACT

An electrical connector (100) includes an insulative housing (1) having a base portion (11), a pair of longitudinal supporting arms (13) connected to the base portion, and a tongue portion (12) extending forwardly from the base portion to be located between the supporting arms and having a number of passageways (16, 17); a number of contacts (2) defining a plurality of contacting arms (211, 221) and soldering portions (213, 223) and received in the passageways; a shell (3) mounted on the insulative housing and enclosing the tongue portion to define a receiving space (4) therebetween, having a top wall (30), a bottom wall (32) being positioned below the longitudinal supporting arms, and a pair of side walls (31) connecting the top wall and the bottom wall, the top wall defines an abutting plate (33) extending backwardly and engaging with a top surface of the base portion, the pair of side walls are disposed between the longitudinal supporting arms.

17 Claims, 12 Drawing Sheets

LOW PROFILE ELECTRICAL CONNECTOR

BACKGROUND OF THE INVENTION

1. Field of the Invention

The present invention generally relates to a low profile electrical connector mounted on a printed circuit board, and particularly to an electrical connector which is disposed within the printed circuit board.

2. Description of Related Art

There is an obvious tendency in electronic industry to manufacture electronic devices of low profile, the electronic devices generally consist of various printed circuit boards and electrical connectors which are mounted on the corresponding printed circuit board, said connectors are required to be small in size and occupy less inner space of the electronic devices. Such connector is disclosed in U.S. Pub. No. 2007/0117459 and comprises an insulative housing, a plurality of terminals disposed in the housing and a metal shell enclosing the housing, said connector is mounted onto a printed circuit board having a number of position holes and an open space for receiving a lower portion of the connector. The housing includes a pair of posts in a rear portion thereof to be mounted in the position holes in a rear portion of the printed circuit board. The shell defines four soldering legs to be secured in the position holes in the front and middle portion of the printed circuit board. However, the soldering legs are slit from two side walls of the shell, accordingly, four cutouts are formed in the side walls of the shell, thus causing adverse effect of preventing electronic magnetic interference (EMI). Electrical connectors for transmitting high speed signals are required to have desirable shielding characteristic, therefore, the shell with more than four cutouts is not suitable for high-speed electrical connector.

It is thus desired to provide an improved connector to overcome the shortcomings described above.

SUMMARY OF THE INVENTION

An object of the present invention is to provide a low profile electrical connector.

Another object of the present invention is to provide a high-speed electrical connector having desirable shielding effect.

In order to achieve above-mentioned object, an electrical connector includes an insulative housing having a base portion, a pair of longitudinal supporting arms connected to the base portion, and a tongue portion extending forwardly from the base portion to be located between the supporting arms and having a number of passageways; a number of contacts defining a plurality of contacting arms and soldering portions and received in the passageways; a shell mounted on the insulative housing and enclosing the tongue portion to define a receiving space therebetween, having a top wall, a bottom wall being positioned below the longitudinal supporting arms, and a pair of side walls connecting the top wall and the bottom wall, the top wall defines an abutting plate extending backwardly and engaging with a top surface of the base portion, the pair of side walls are disposed between the longitudinal supporting arms.

Other objects, advantages and novel features of the present invention will become more apparent from the following detailed description of the present embodiment when taken in conjunction with the accompanying drawings.

DETAILED DESCRIPTION OF THE INVENTION

Figure 1:
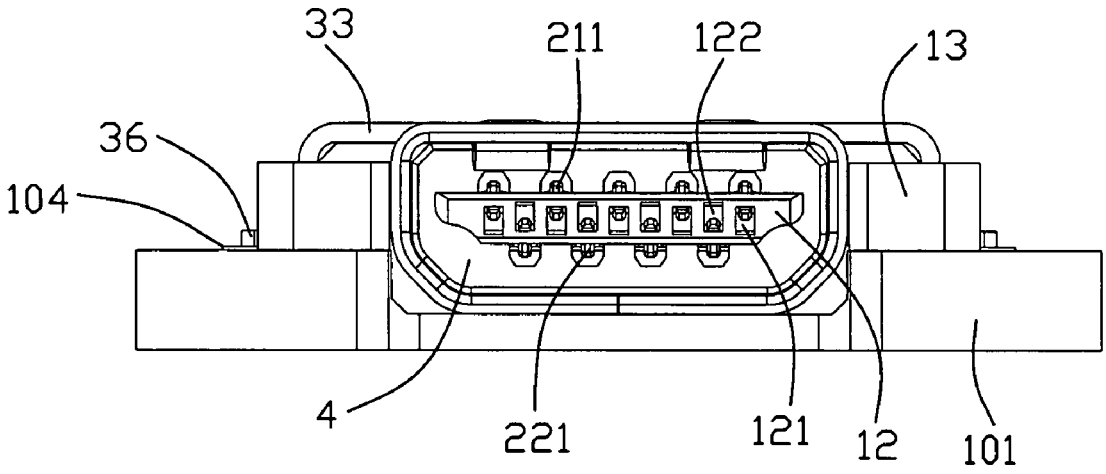
FIG. 1 is a front view of an electrical connector mounted on a printed circuit board according to the present invention.

Reference will now be made to the drawing figures to describe the preferred embodiment of the present invention in detail.

Figure 2:
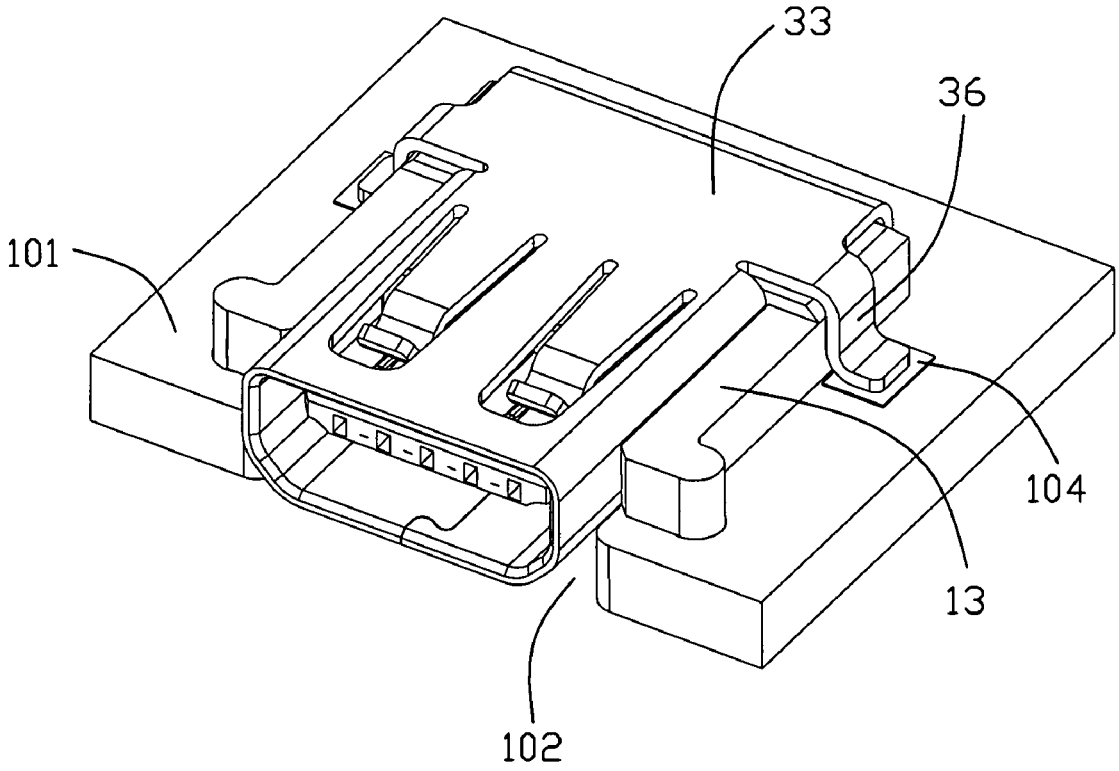
FIG. 2 is a perspective view of the electrical connector and the printed circuit board shown in FIG. 1.
Figure 3:
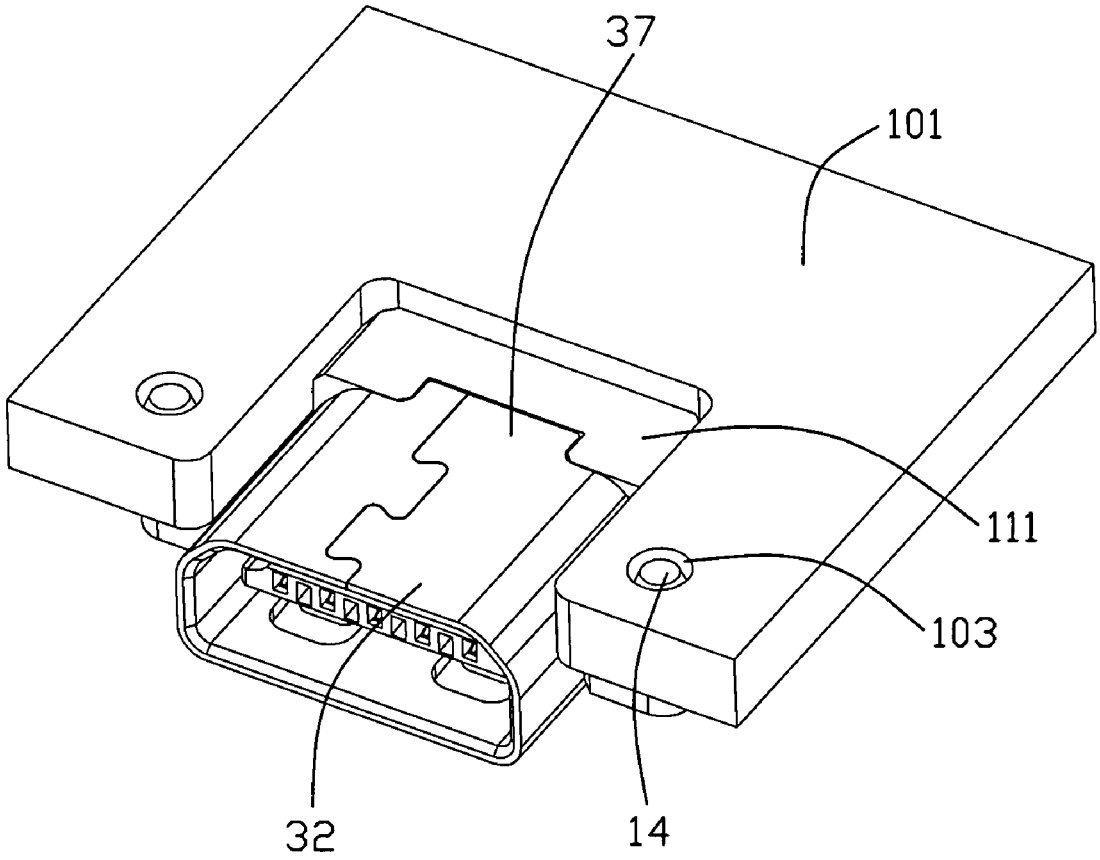
FIG. 3 is a view similar to FIG. 2, while taken from a different aspect.
Figure 4:
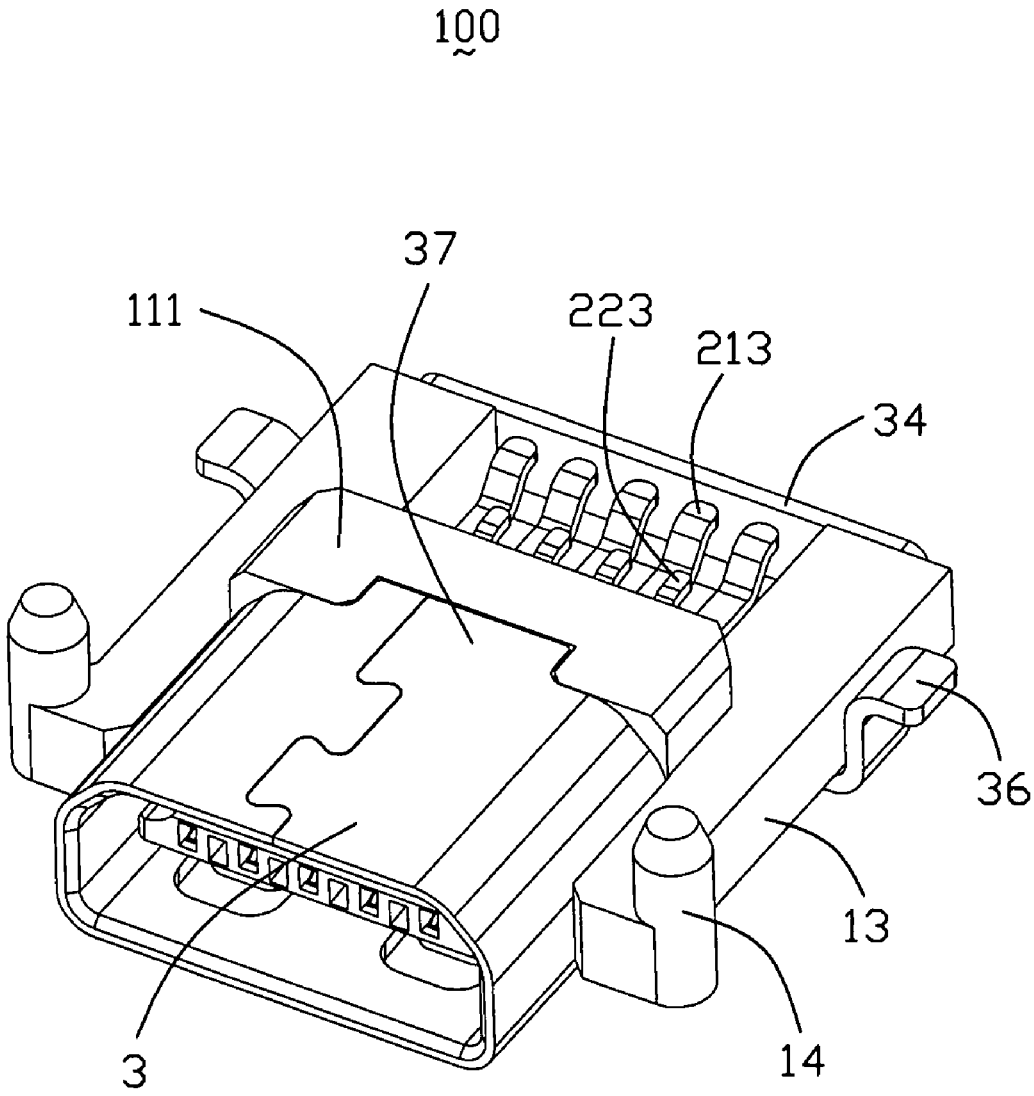
FIG. 4 is a perspective view of the electrical connector of FIG. 1.
Figure 5:
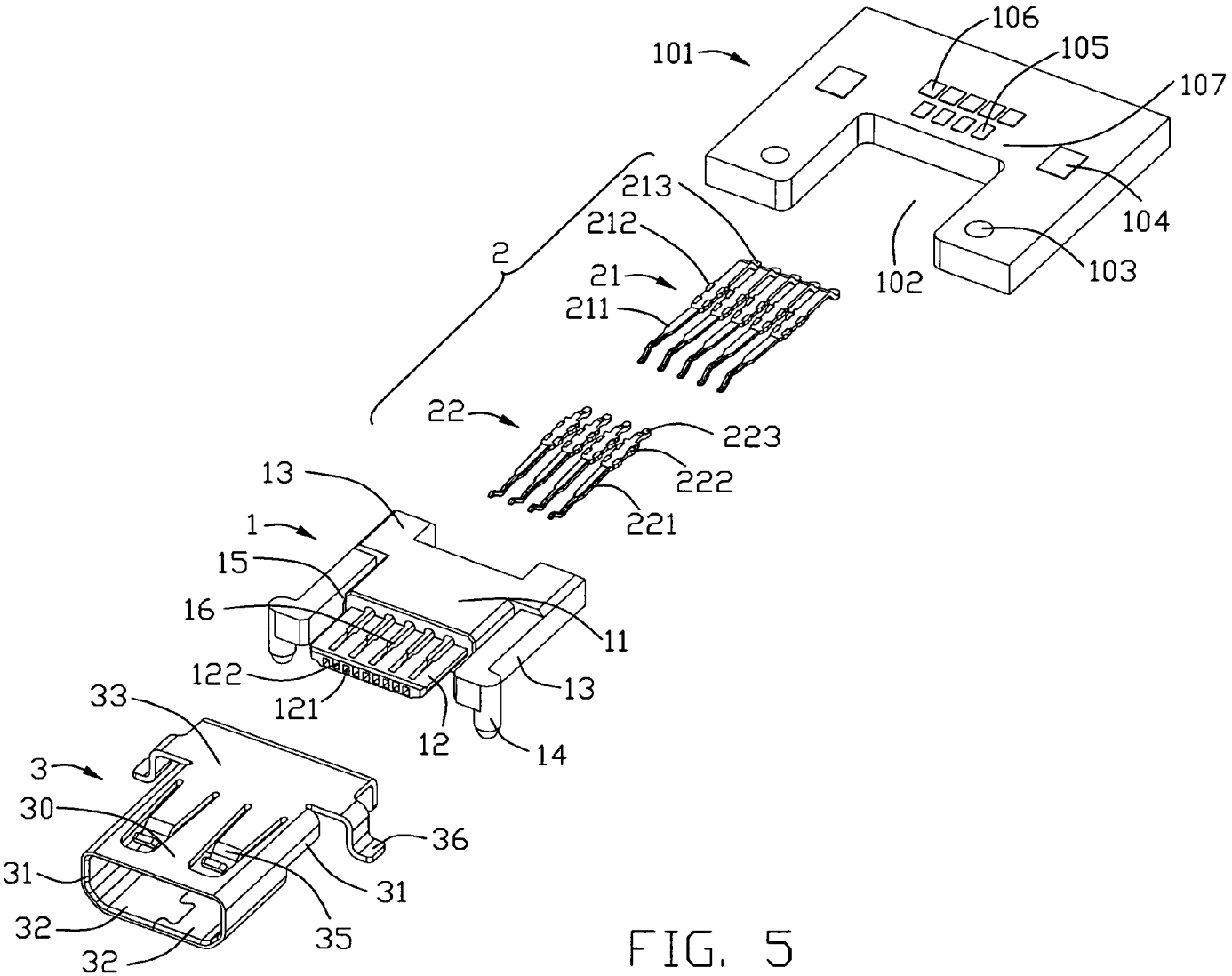
FIG. 5 is an exploded perspective view of the electrical connector and the printed circuit board shown in FIG. 1.
Figure 6:
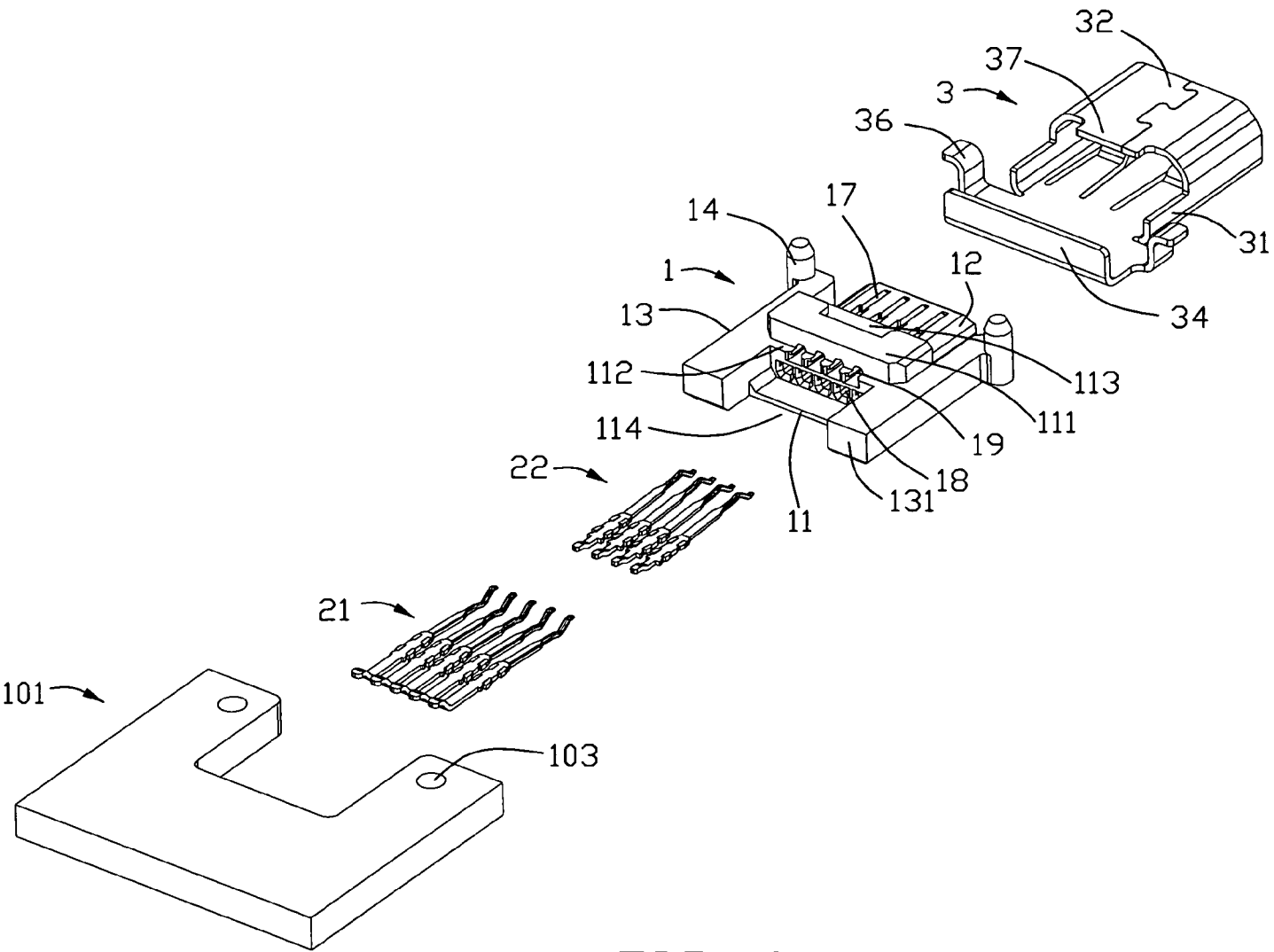
FIG. 6 is a view similar to FIG. 5, while taken from a different aspect.

Referring to FIGS. 1-6, an electrical connector 100 according to the present invention is preferably a high-speed USB receptacle connector adapted to be mounted on a printed circuit board 101, comprises an insulative housing 1, a plurality of contacts 2 received in the housing 1 and a shielding shell 3 enclosing the housing 1. The printed circuit board 101 defines an through opening 102 in a front end thereof for receiving the electrical connector 100, a pair of front through holes 103 located on opposite sides of the opening 102 for securing the housing 1, a first row of solder pads 105 and a second row of solder pads 106 which are parallel to each other and positioned on a rear portion thereof, and a pair of outer solder pads 104 for connecting with the shell 3, the contacts 2 are soldered to the first row of solder pads 105 and the second row of solder pads 106.

The housing 1 comprises an base portion 11 having a board engaging surface 112 on a bottom side thereof for contacting with an upper surface 107 of the printed circuit board 101, a tongue portion 12 extending forwardly therefrom and a pair of longitudinal supporting arms 13 projecting from side edges of the base portion 11, the rear ends of the supporting arms 13 project beyond the rear edge of the base portion 11. The board engaging surface 112 and the longitudinal supporting arms 13 are mounted onto the upper surface 107 of the printed circuit board 101, a longitudinal slit 15 is formed between the base portion 11 and a front portion of the longitudinal supporting arm 13 so that the shell 3 can be sandwiched between the base portion 11 and the longitudinal supporting arm 13 along a lateral direction. A protrusion block 111 is provided on a bottom side of the base portion 11 to extend downwardly from the board engaging surface 112. A retaining post 14 extends downwardly from a front end of the longitudinal supporting arm 13 to be inserted in the corresponding front through holes 103 of the printed circuit board 101, thereby attaching the housing 1 to the printed circuit board 101. The retaining post 14 is located on an outmost side of the longitudinal supporting arm 13. The tongue portion 12 is thinner than the base portion 11 and is surrounded by the shell 3 to form a receiving space 4 therebetween.

The contact 2 includes five upper contacts 21 and four lower contacts 22 which are alternatively received in the housing 1 and located on opposite sides of the tongue portion 12 respectively. The tongue portion 12 defines five upper passageways 16 extending through an upper surface thereof and four lower passageways 17 extending through a lower surface thereof. The lower passageways 17 and the upper passageways 16 are alternatively arranged along a lateral direction of the tongue portion 12. A plurality of front retaining holes 121, 122 extend through the front surface of the tongue portion 12 and communicate with the upper passageways 16 and lower passageways 17 respectively. A plurality of upper retaining holes 18 and lower retaining holes 19 are formed on a rear portion of the base portion 11 to be aligned with the corresponding upper passageways 16 and the corresponding lower passageways 17 respectively. The upper contacts 21 and the lower contacts 22 are inserted into housing 1 from a rear portion thereof.

The upper contacts 21 and the lower contacts 22 each comprises a fixing portion 212, 222 retained in the upper and the lower retaining holes 18, 19 respectively, a contacting arm 211, 221 extending from a front end of the fixing portion 212, 222, and a soldering portion 213, 223 extending from a rear end of the fixing portion 212, 222. The contacting arm 211 is disposed in the upper passageway 16 and projects beyond the tongue portion 12 for contacting with a complementary USB plug (not shown). Distal end of the contacting arm 211 bias against an inner wall of the front retaining holes 121. The contacting arm 221 is disposed in the lower passageway 17 and projects beyond the tongue portion 12 for contacting with the complementary USB plug. Distal end of the contacting arm 221 bias against an inner side wall of the front retaining holes 122. The soldering portions 213, 223 extend out of the rear end of the base portion 11 to be received in a receiving room 114 formed by the base portion 11 and rear portions of the longitudinal supporting arms 13. The soldering portions 213 are surface mounted onto the second row of solder pads 106 and the soldering portions 223 are surface mounted onto the first row of solder pads 105. The soldering portions 213, 223 are alternatively arranged along a lateral direction of the housing 1. The soldering portions 213, 223 are disposed between the longitudinal supporting arms 13 and the shell 3.

The shell 3 is stamped from a metal plate and includes a top wall 30, a pair of side walls 31, a pair of bottom walls 32 which are locked with each other. The side walls 31 engage with inner side walls of the longitudinal supporting arm 13. A rear end of the side wall 31 is received in the slit 15 and sandwiched by the base portion 11 and the longitudinal supporting arm 13. The top wall 30 is provided with an abutting plate 33 extending backwardly and laterally therefrom, the abutting plate 33 projects a predetermined distance beyond a rear edge of the side wall 31 to abut against a top surface of the base portion 11. A rear wall 34 is folded vertically from the abutting plate 33 to bias against a rear surface 131 of the longitudinal supporting arm 13. A pair of spring tabs 35 project into the receiving space 4 for contacting with an outer surface of the mating USB plug. The abutting plate 33 is formed with a pair of soldering legs 36 extending laterally and downwardly from opposite side edges thereof for soldering onto the outer solder pads 104 respectively. The soldering legs 36 are aligned with the retaining post 14 along a lengthwise direction the shell 3, in other embodiments, the soldering legs 36 may be arranged outside the retaining post 14 along a lengthwise direction the shell 3. The bottom wall 32 defines a protrusion tab 37 extending backwardly therefrom. A cutout 113 is provided on the bottom side of the protrusion block 111 to fix the protrusion tab 37.

The electrical connector 100 is partially disposed within the through opening 102 of the printed circuit board 101 so that the overall height of the electrical connector 100 and the printed circuit board 101 is decreased. The height of the electronic device on which the electrical connector 100 and the printed circuit board 101 are mounted is diminished. Two soldering legs 36 are surface mounted to the outer solder pads 104 for securing the shell 3 to the printed circuit board 101, compared to the shell in U.S. Pub. No. 2007/0117459, the shell 3 is simplified. The longitudinal supporting arms 13 of the housing 1 are mounted on the printed circuit board 101 along a longitudinal direction of the housing 1, thereby the electrical connector 100 is supported on a large region of the printed circuit board 101. Furthermore, the soldering legs 36 of the shell 3 straddle on the longitudinal supporting arms 13 so that the intensity of the shell 3 is strengthened.

Figure 7:
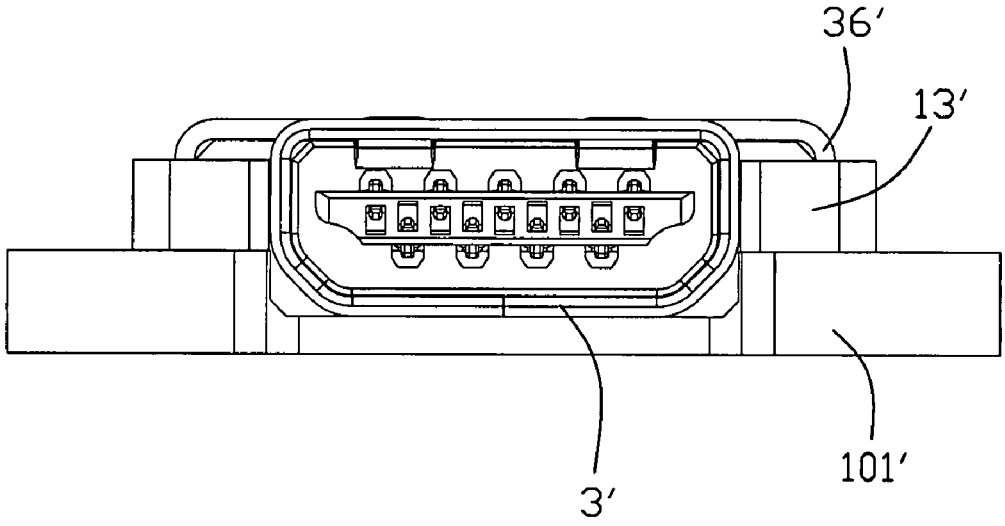
FIG. 7 is a front view of a second embodiment of the electrical connector and the printed circuit board.
Figure 8:
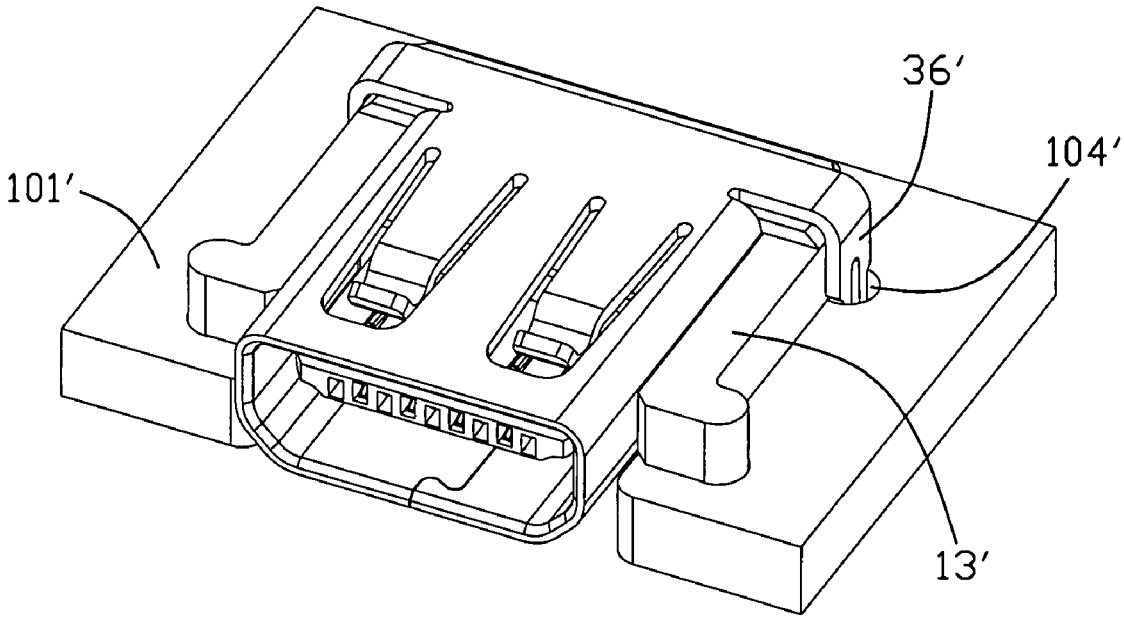
FIG. 8 is a perspective view of the electrical connector and the printed circuit board shown in FIG. 7.
Figure 9:
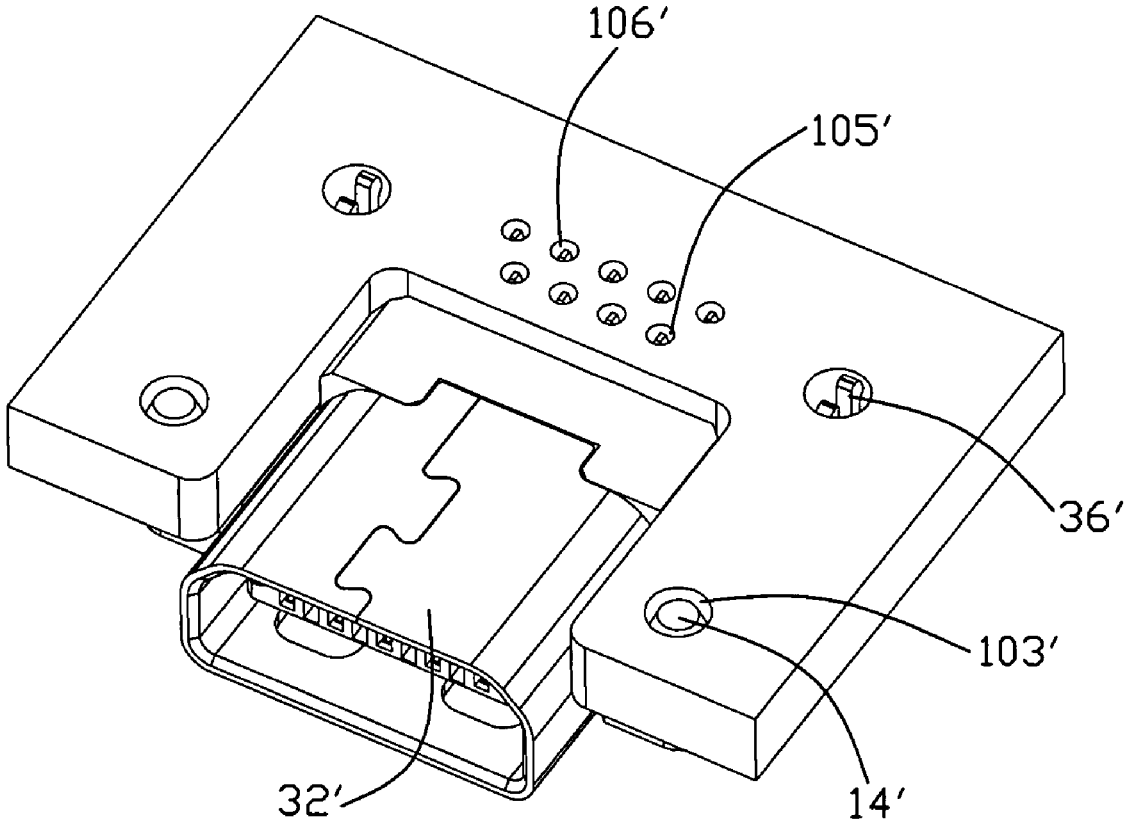
FIG. 9 is a view similar to FIG. 8, while taken from a different aspect.
Figure 10:
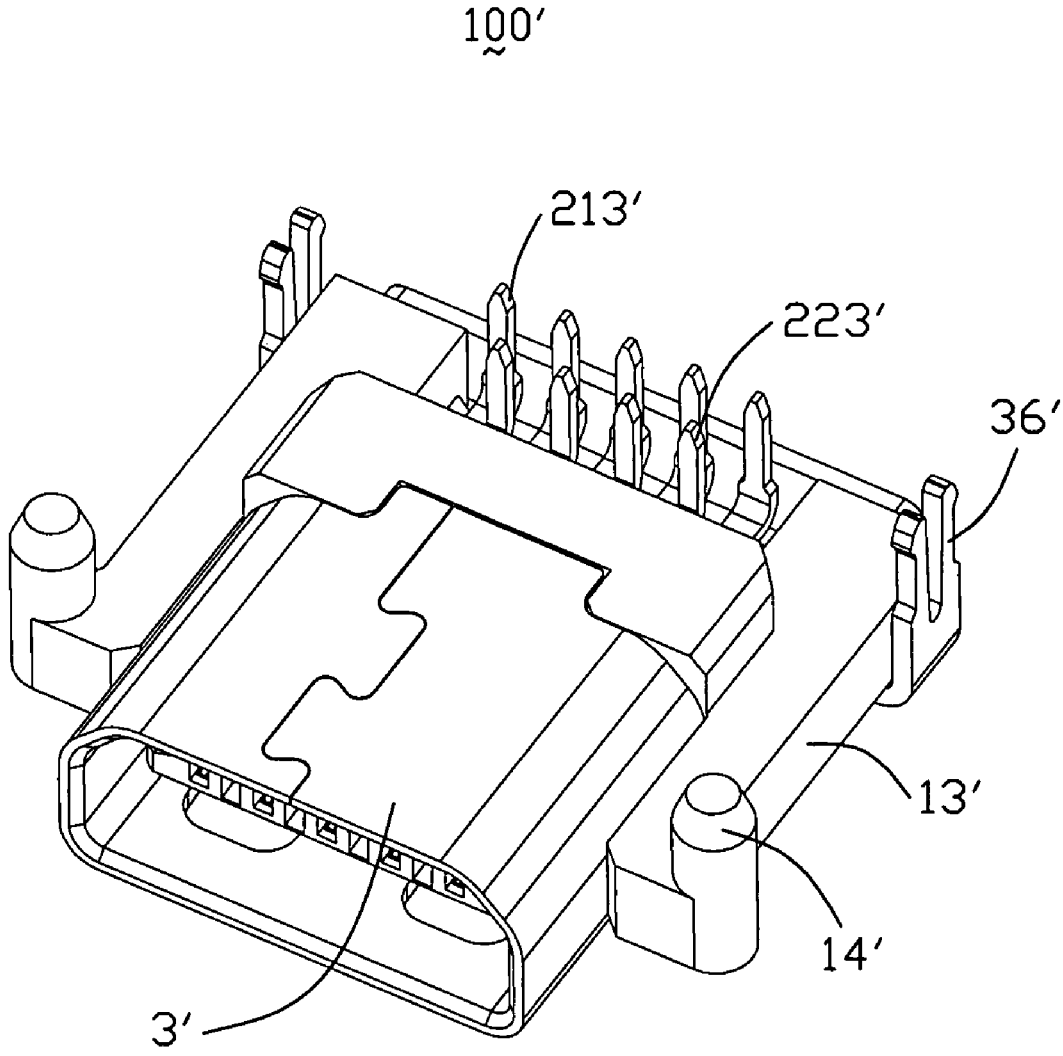
FIG. 10 is an assembled perspective view of the electrical connector shown in FIG. 7.
Figure 11:
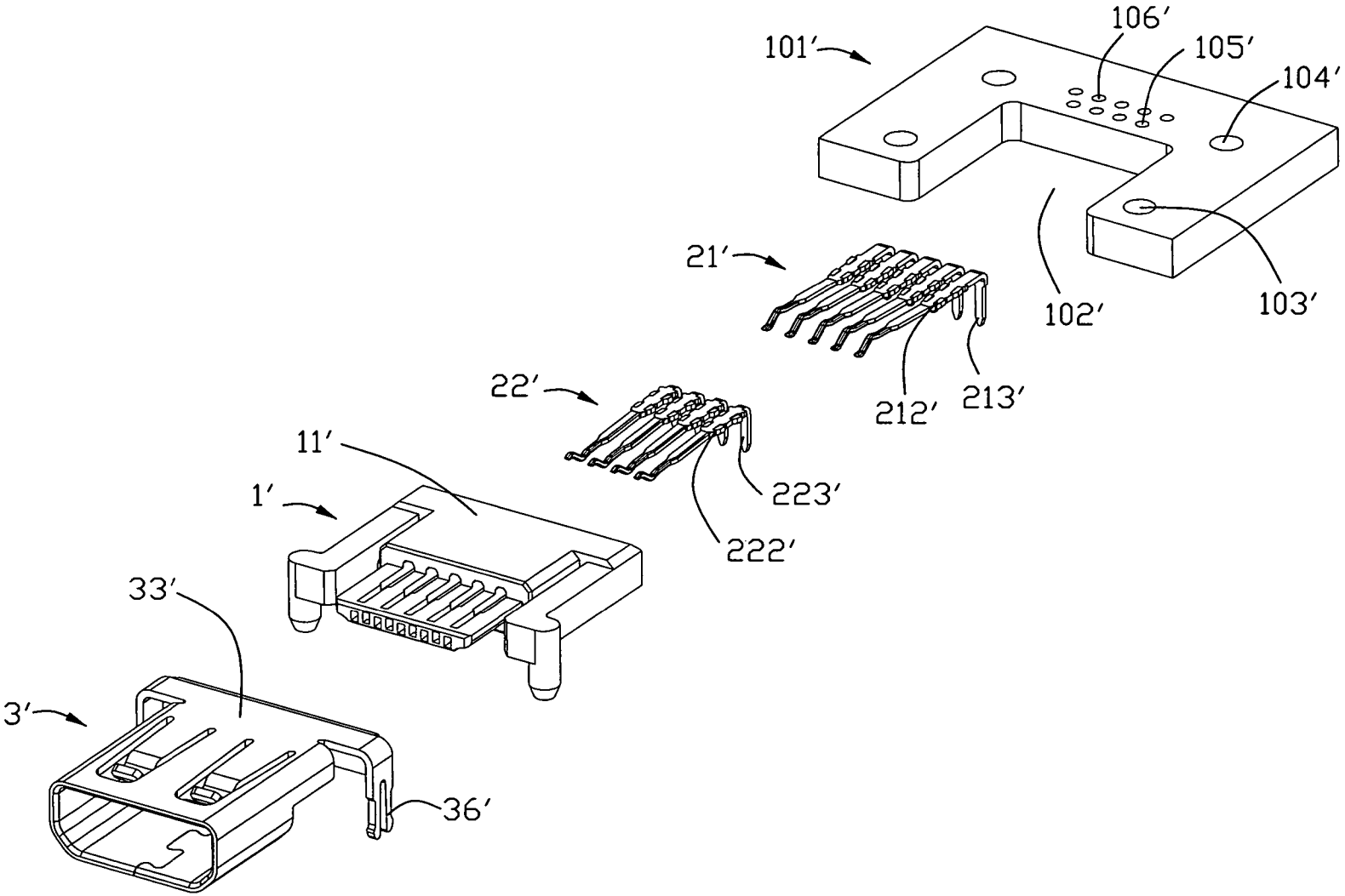
FIG. 11 is an exploded perspective view of the electrical connector and the printed circuit board shown in FIG. 7.
Figure 12:
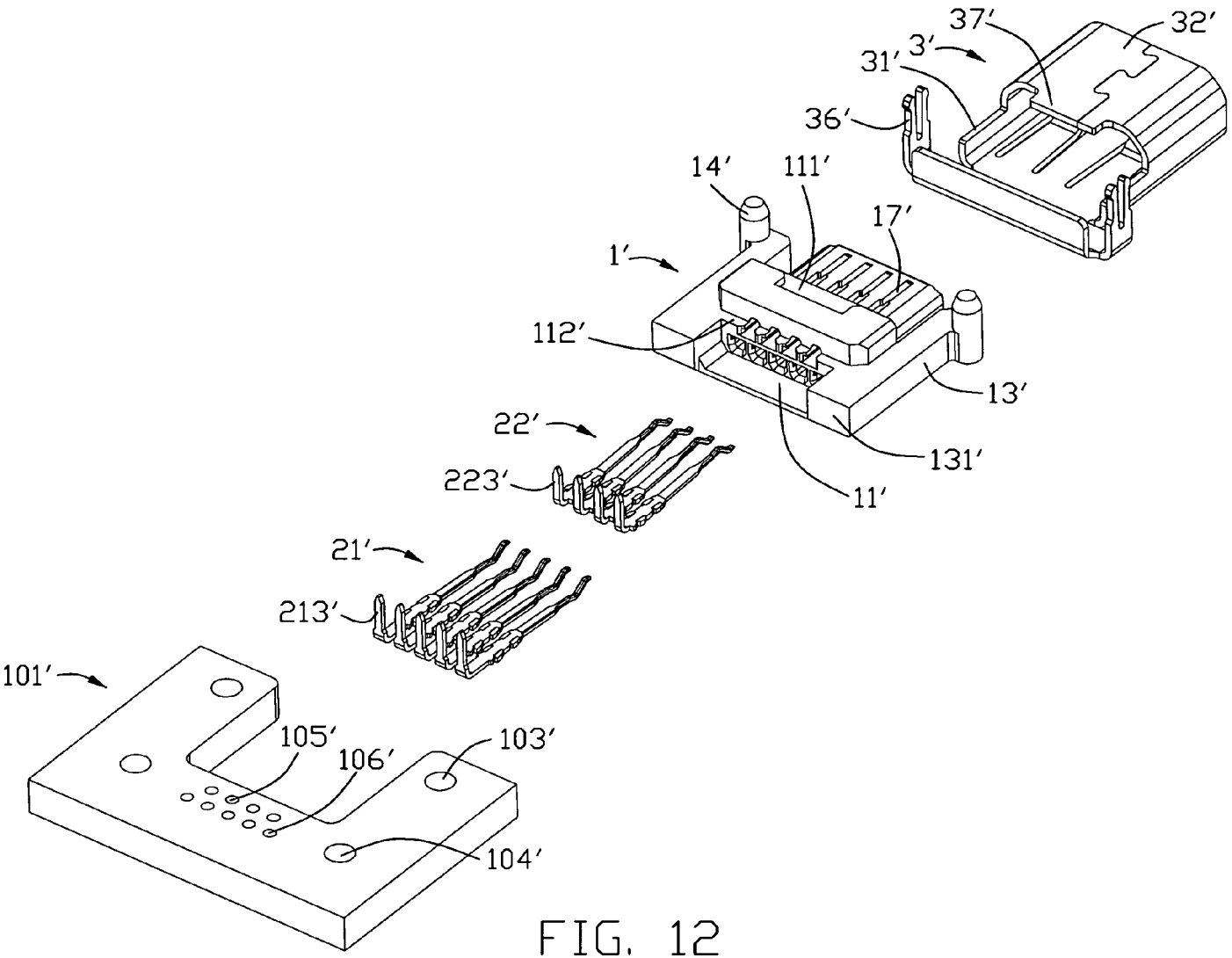
FIG. 12 is a view similar to FIG. 11, while taken from a different aspect.

FIGS. 6-12 show another embodiment of the electrical connector 100' which is similar to the above described electrical connector 100, except for the structure of the soldering portions 213', 223' of the contact 21', 22' and soldering legs 36' of the shell 3'. The electrical connector 100' is of through-hole type for being soldered to the printed circuit board 101', accordingly, the first row of solder pads 105 and the second row of solder pads 106 of the printed circuit board 101 are replaced with a first row of soldering holes 105' and a second row of soldering hole 106' respectively. The soldering portions 213', 223' extend perpendicularly from the fixing portion 212', 222' for insertion into the soldering holes 106', 105' respectively. The outer solder pads 104 of the printed circuit board 101 are replaced with outer soldering holes 104' in the same region, and the soldering legs 36' of the shell 3' project vertically and downwardly from side edges of the abutting plate 33' to be secured in the outer soldering holes 104'. The rear surface 131' of the longitudinal supporting arm 13' are formed integrally with the base portion 11' and substantially coplanar with the rear edge of the base portion 11'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion, a pair of longitudinal supporting arms connected to the base portion and a tongue portion extending forwardly from the base portion and being located between the longitudinal supporting arms, the tongue portion having a plurality of passageways;

a plurality of contacts received in the passageways and defining a plurality of upper contacts and a plurality of lower contacts which are alternatively arranged along a lateral direction of the tongue portion, the contacts defining a plurality of contacting arms and soldering portions;

a shell mounted on the insulative housing and enclosing the tongue portion to define a receiving space therebetween, having a top wall, a bottom wall being positioned below the longitudinal supporting arms, and a pair of side walls connecting the top wall and the bottom wall, the top wall defining an abutting plate extending backwardly and engaging with a top surface of the base portion, the pair of side walls disposed between the longitudinal supporting arms.

2. The electrical connector as claimed in claim 1, wherein the abutting plate defines a pair of soldering legs extending downwardly from side edges thereof and being located above the bottom wall, the soldering legs straddle on the longitudinal supporting arms.

3. The electrical connector as claimed in claim 2, wherein the soldering legs are positioned outside the side walls of the shell, the shell has a rear wall extending perpendicularly from the abutting plate and biasing against a rear surface of the longitudinal supporting arms.

4. The electrical connector as claimed in claim 1, wherein the base portion has a cutout recessed from a bottom side thereof, the bottom wall of the shell has a protrusion tab extending backwardly and being retained in the cutout.

5. The electrical connector as claimed in claim 1, wherein the soldering portions are disposed between the longitudinal supporting arms and the shell and are alternatively arranged along a lateral direction of the housing.

6. The electrical connector as claimed in claim 1, wherein the tongue portion defines a plurality of retaining holes exposed to a front side surface thereof and communicating with the corresponding passageways, the upper contacts and the lower contacts each has a distal end received in the corresponding retaining holes.

7. The electrical connector as claimed in claim 1, wherein the tongue portion is spaced from the longitudinal supporting arms in a lateral direction of the housing, the housing defines a pair of longitudinal slits between the base portion and the longitudinal supporting arms, the side walls are retained in the slits.

8. The electrical connector as claimed in claim 1, wherein the longitudinal supporting arms each has a retaining post extending downwardly therefrom, the retaining post is located on an outmost side of the longitudinal supporting arm.

9. An electrical connector assembly comprising:

a printed circuit board defining a notch in a front edge region;

an electrical connector including:

an insulative housing having a main body received in the notch and defining a mating tongue thereof;

a plurality of contacts disposed in the housing and exposed upon the mating tongue;

a metallic shell having a main section received in the notch and enclosing the main body; wherein the housing further includes a pair of arms by two sides of the main section and seated upon the printed circuit board so as to retain the housing upon the printed circuit board; wherein an upper surface of the printed circuit board is generally at a same level with a lower face of the mating tongue.

10. The electrical connector assembly as claimed in claim 9, wherein the shell includes a rear section located behind the notch and extending laterally beyond a transverse dimension of the notch to retain the shell upon the printed circuit board.

11. The electrical connector assembly as claimed in claim 9, wherein a bottom plate of said main section of the shell is essentially located at a middle level of said notch.

12. The electrical connector assembly as claimed in claim 9, wherein the contacts define a plurality of upper contacts and a plurality of lower contacts which are alternatively arranged along a lateral direction of the mating tongue.

13. The electrical connector assembly as claimed in claim 12, wherein the mating tongue defines a plurality of retaining holes exposed to a front side surface thereof, the upper contacts and the lower contacts each has a distal end received in the corresponding retaining holes.

14. An electrical connector comprising:

an insulative housing comprising a base portion, a tongue portion extending forwardly from the base portion, the tongue portion having a plurality of passageways;

a plurality of contacts received in the passageways and defining a plurality of upper contacts and a plurality of lower contacts, the upper contacts and the lower contacts being alternatively arranged along a lateral direction of the tongue portion, the contacts each defining a contacting arm and a soldering portion;

a shell mounted on the insulative housing to enclose the tongue portion to define a receiving space therebetween, and having a top wall, a bottom wall, and a pair of side walls connecting the top wall and the bottom wall.

15. The electrical connector as claimed in claim 14, wherein the tongue portion defines a plurality of retaining holes exposed to a front side surface thereof and communicating with the corresponding passageways, the upper contacts and the lower contacts each has a distal end received in the corresponding retaining holes.

16. The electrical connector as claimed in claim 14, wherein the tongue portion defines an upper surface and a lower surface opposite to the upper surface, the contacting arms of the upper contacts extend upwardly and beyond the upper surface, the contacting arms of the lower contacts extend downwardly and beyond the lower surface.

17. The electrical connector as claimed in claim 14, wherein the base portion has a cutout recessed from a bottom side thereof, the bottom wall of the shell has a protrusion tab extending backwardly and being retained in the cutout.

* * * * *